US006732785B2

(12) United States Patent
Mitchell

(10) Patent No.: US 6,732,785 B2
(45) Date of Patent: May 11, 2004

(54) TAB JOINT IN ETCHED FOIL REGENERATOR

(76) Inventor: Matthew P. Mitchell, 151 Alvarado Rd., Berkeley, CA (US) 94705

( * ) Notice: Subject to any disclaimer, the term of this patent is extended or adjusted under 35 U.S.C. 154(b) by 68 days.

(21) Appl. No.: 10/251,708

(22) Filed: Sep. 20, 2002

(65) Prior Publication Data

US 2004/0055737 A1 Mar. 25, 2004

(51) Int. Cl.[7] ..... F28F 7/00

(52) U.S. Cl. ..... 165/79; 165/10; 165/4; 29/890.034; 29/890.039; 29/17.4

(58) Field of Search ..... 165/4, 10, 77, 165/78, 79; 29/17.4, 17.7, 890.034, 890.039

(56) References Cited

U.S. PATENT DOCUMENTS

| | | | | |
|---|---|---|---|---|
| 4,364,686 A | | 12/1982 | Sharp | |
| 4,669,535 A | * | 6/1987 | Seidler | 165/78 |
| 5,119,862 A | * | 6/1992 | Maimets et al. | 138/98 |
| 5,429,177 A | | 7/1995 | Yaron | |
| 5,761,811 A | * | 6/1998 | Ito | 29/890.054 |
| 6,115,919 A | * | 9/2000 | Oswald et al. | 29/890.039 |
| 6,619,046 B1 | * | 9/2003 | Mitchell | 62/6 |
| 6,619,381 B1 | * | 9/2003 | Lee | 165/78 |
| 6,651,332 B2 | * | 11/2003 | Matsuzaki | 29/890.039 |

FOREIGN PATENT DOCUMENTS

| | | | | |
|---|---|---|---|---|
| FR | 2201545 | * | 9/1972 | 165/177 |
| GB | 2054818 A | * | 2/1981 | 165/77 |

OTHER PUBLICATIONS

Mitchell, paper entitled "Assembly Technique for Foil Regenerator", presented at "Low Power Cryocoolers" conference, Venlo, Netherlands, Jun. 1, 1999 pp. 6–10.

VACCO Industries sketch entitled "Interlocking Foil Concept" furnished May 2, 2001.

* cited by examiner

*Primary Examiner*—Terrell McKinnon

(57) ABSTRACT

A joint connecting consecutive sheets of etched regenerator foil for a spiral-wrapped regenerator of a regenerative gas cycle machine such as a Stirling cycle engine or Stirling, pulse tube, or Gifford-McMahon cryocooler. The joint comprises a multiplicity of tabs on the end of one sheet of regenerator foil interlocked with a multiplicity of tabs on the end of another piece of regenerator foil. The joint is no thicker than the original thickness of the sheets of etched regenerator foil that it connects together, and the tabs substantially fill the holes into which they are locked, minimizing undesirable leakage through the joint after it has been incorporated in a regenerator.

17 Claims, 12 Drawing Sheets

1 mm 1 mm

TAB JOINT IN ETCHED FOIL REGENERATOR

CROSS REFERENCE TO RELATED APPLICATIONS

My co-pending application Ser. No. 09/903,302 describes patterns for etched foil materials that may be assembled to form regenerators using the tab connection of this invention. My co-pending application Ser. No. 09/084,042 describes foil regenerators assembled by alternate means.

GOVERNMENT RIGHTS

The invention was made with Government support under contract F29601-99-C-0171 awarded by the United States Air Force. The Government has certain rights in the invention.

BACKGROUND

1. Field of Invention

This invention relates to regenerators including regenerators for regenerative gas cycle machinery, and in particular, to tab connectors linking separate pieces of etched regenerator foil.

2. Description of Prior Art

Regenerative gas cycle machines are a class of machinery that includes Stirling cycle engines and Stirling cycle, Gifford-McMahon and pulse tube refrigerators. A regenerator is a critical component of all regenerative gas-cycle machines. In theory, a parallel-plate configuration offers a more favorable relationship between heat transfer and pressure drop than any other regenerator configuration, maximizing regenerator effectiveness. To make a parallel plate regenerator with the tight flow passages required for service in regenerative gas cycle machinery, spaced layers of foil have been tried. In practice, performance of foil regenerators often has been disappointing. In part, that disappointing performance has been due to difficulty in creating and assembling foil regenerators with uniform flow channels.

Regenerative gas cycle machines, including both engines and refrigerators, have been constructed with annular regenerators. Those regenerators have been constructed with a continuous spiral wrap of solid metal foil using ridges or dimples in the metal to separate the layers from each other. However, because it is difficult to create dimples of uniform depth and because there can be no cross-flow through the solid foil to adjust pressure differences between different layers, uniform flow patterns have not been achieved and performance of foil regenerators has been limited.

Some of the problems of foil regenerators are met by using a photo-etched sculpted foil regenerator disclosed in U.S. Pat. No. 5,429,177, which allows cross-flows through perforations in the layers of foil. My co-pending application Ser. No. 09/903,302 describes improved patterns for etched foil materials that further improve regenerator performance. However, it is difficult to make regenerator foil in lengths exceeding about 1 meter by batch processes of photo-etching and prohibitively expensive to make it in small quantities in continuous form. For best performance, all regenerator foil should be of the same density. However, it is difficult to make large pieces of photo-etched regenerator foil of uniform density. Thus, to maximize the yield of usable material emerging from the etching process, it is desirable to manufacture etched regenerator foil in strips substantially less than one meter long. Except for the smallest cryocoolers, a single piece of etched regenerator foil is too short to make a complete regenerator and several pieces of etched foil must therefore be spliced to make a spiral-wrapped regenerator.

Splicing foils end-to-end is difficult because the foils are thin and delicate, thus difficult to align with the required precision, and subject to damage in handling. Welding and gluing are two methods of splicing foil that have been tried. Both are difficult and expensive. Stringent requirements with respect to outgassing limit the bonding materials that can be used to join the ends of a foil strip to be used in a cryocooler application. No fully satisfactory, inexpensive method of splicing has been demonstrated heretofore.

Moreover, if a long strip of regenerator foil is welded or glued together from several shorter strips of etched regenerator foil material, the long strip becomes difficult to handle without damaging the foil. For satisfactory performance as a regenerator, the foil must be rolled tightly. Any kinks or ripples in the foil will tend to prevent the adjacent layers of foil from lying tightly against the kinked or rippled portion. Thus, a strip of welded regenerator foil requires especially careful handling, adding to the expense of assembly.

The use of tabs to connect separate pieces of etched foil is known to the etched foil art in applications such as coffee machine filters. However, in prior art tab arrangements, a tab passes through a hole in another piece of foil (or another part of the same piece of foil) and locks into place leaving a portion of the hole open. That arrangement is unsatisfactory in a foil regenerator because the open hole would create a flow path for fluid the full thickness of the foil and thus larger than flow paths etched into the surface of the foil. It would permit fluid moving in flow channels on adjacent layers of foil to short-circuit through the open hole instead of passing through the intended passages etched into those layers. The large flow path created by the opening would thus spoil the even distribution of flow throughout the regenerator, reducing its effectiveness. Prior art tab arrangements in which the tab retains the full thickness of the foil from which it etched are also unsatisfactory because the joint would be thicker than a single layer of foil, and would creates a linear lump in the regenerator that would open up large, unwanted flow passages adjacent to the joint.

SUMMARY

The tab connection of this invention solves problems in assembly of etched regenerator foil into finished regenerators. It permits connection of consecutive pieces of regenerator foil with joints that are no thicker at any point than the parent foil from which the regenerator foil has been etched. It seals the holes in the foil through which tabs are inserted, eliminating leak paths that would otherwise spoil the performance of a regenerator assembled using prior art tab arrangements. A half-etched tongue on a tab can prevent distortion of the tab when the joint is placed in tension during the process of rolling the regenerator.

OBJECTS AND ADVANTAGES

Several objects and advantages of this invention are:

(1) To provide a high performance foil regenerator for use in gas cycle machines.

(2) To provide reliable joints between adjacent pieces of regenerator foil.

(3) To provide joints between adjacent pieces of regenerator foil that are no thicker than the parent foil from which those adjacent pieces of regenerator foil have been fabricated.

(4) To provide joints that do not create unintended leak paths through etched foil regenerators.

(5) To improve yield and quality of etched foil elements to be employed in etched foil regenerators.

(6) To provide high performance foil regenerators for use in regenerative gas cycle machinery.

Further objects and advantages will become apparent from a consideration of the ensuing description and drawings.

DRAWING FIGURES

REFERENCE NUMERALS IN DRAWINGS

Figure 1:
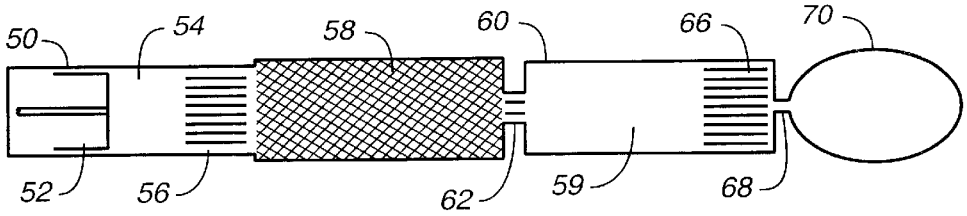
FIG. 1 (PRIOR ART)
FIG. 1 is a schematic view of a prior art orifice pulse tube refrigerator in linear arrangement.

50 compressor
51 first cylinder
52 piston
53 displacer
54 compression space
55 second cylinder
56 aftercooler
58 regenerator
59 pulse tube
60 pressure vessel
62 cold heat exchanger
64 expansion space
66 warm heat exchanger
68 orifice
70 reservoir
80 layers of foil
82 central opening
84 mandrel
86 unrolled sheet of foil
87 loose piece of foil
88 regenerator pattern
89 front side of foil
90 strip
92 slot
94 spacer-strap
100 tab end
101 tab
102 tab shoulder
104 tab neck
106 tab ear
108 tab head
109 tab tongue
110 hole end
111 hole
112 hole-end shoulder
113 back edge of hole ear
114 hole ear
115 back edge of hole
116 tongue recess
117 side of hole
118 gap
119 completed joint
120 portion depth-etched from front
121 neck channel
122 portion depth-etched from back
123 portion through-etched
124 unetched foil
125 clearance
126 rotatable shaft
128 upper foil support

130 lower foil support

L1 breadth of tab end shoulder

L2 length of tab neck

L3 length of tab ear

L4 length of tab head

L5 length of tab tongue

W1 width of tab neck

W2 width of tab head

W3 width of tab ear

DESCRIPTION OF PRIOR ART—FIGS. 1–5

FIG. 1 (prior art) is a schematic representation of a prior art pulse tube refrigerator in a linear arrangement. Compressor 50 contains piston 52 which forms one end of compression space 54, which is adjacent to aftercooler 56. Regenerator 58 lies between aftercooler 56 and cold heat exchanger 62. Pulse tube 59 lies between cold heat exchanger 62 and warm heat exchanger 66. Warm heat exchanger 66 is connected to reservoir 70 through orifice 68. A fluid, typically pressurized helium, is contained in pressure vessel 60 which surrounds all of the other components of the refrigerator.

Figure 2:
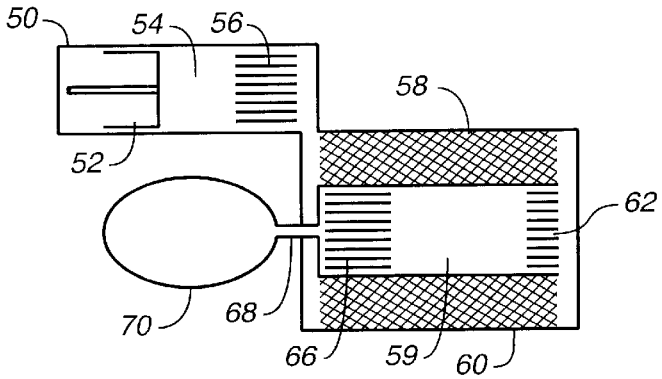
FIG. 2 (PRIOR ART)
FIG. 2 is a schematic view of a prior art orifice pulse tube refrigerator in coaxial arrangement with annular regenerator.

FIG. 2 (prior art) is a schematic representation of a prior art pulse tube refrigerator in a coaxial arrangement. Regenerator 58 surround pulse tube 59. Otherwise, the components of the refrigerator are the same as in FIG. 1.

Figure 3:
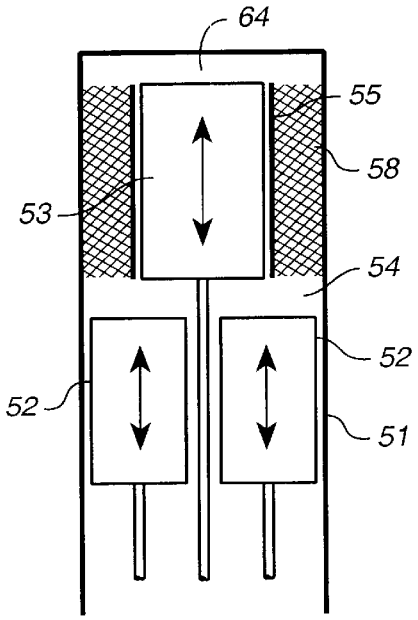
FIG. 3 (PRIOR ART)
FIG. 3 is a schematic view of a portion of a prior art beta type Stirling engine with annular regenerator.

FIG. 3 (prior art) is a schematic representation of a portion of a Stirling Cycle machine. Piston 52 is slidable in first cylinder 51. Displacer 53 is slidable in second cylinder 55. Regenerator 58 surrounds second cylinder 55. Compression space 54 lies between piston 52 and displacer 53. Expansion space 64 is separated from compression space 54 by displacer 53 and regenerator 58.

Figure 4:
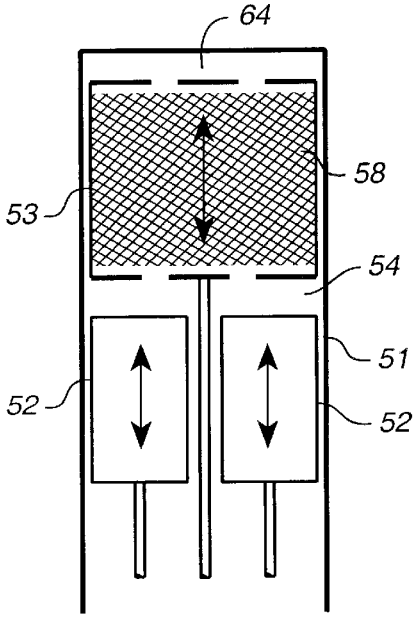
FIG. 4 (PRIOR ART)
FIG. 4 is a schematic view of a portion of a prior art beta type Stirling engine with regenerator in displacer.

FIG. 4 (prior art) is a schematic representation of a portion of a Stirling cycle machine. It differs from the machine illustrated in FIG. 3 in that regenerator 58 is housed inside displacer 53 and displacer 53 is slidable in first cylinder 51.

Figure 5:
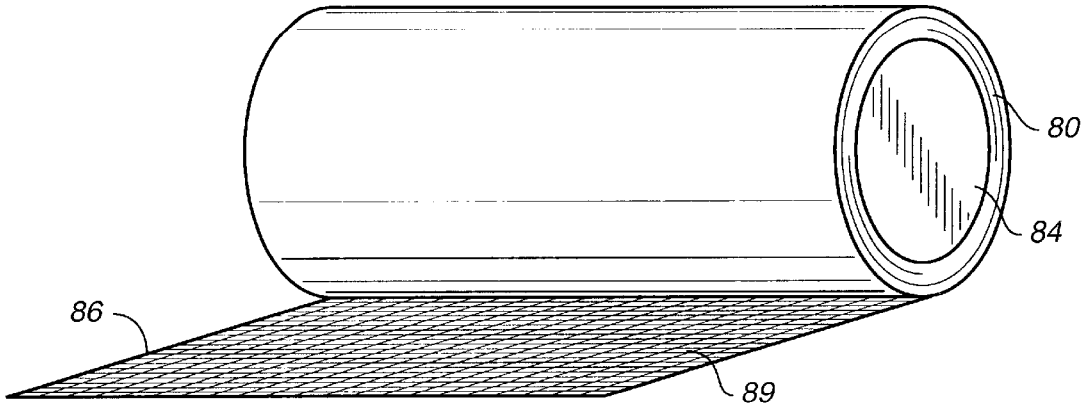
FIG. 5 (PRIOR ART)
FIG. 5 is a perspective view of a prior art foil regenerator, partially spiral-wrapped on a mandrel.

FIG. 5 (prior art) is a perspective view of a partially-unrolled foil regenerator wherein layers of foil 80 are wrapped on mandrel 84. An unrolled sheet of foil 86 has flow channels etched on the front side of foil 89.

DESCRIPTION OF THE INVENTION—FIGS. 6–11B, 14A–14B—PREFERRED EMBODIMENT

In the preferred embodiments of this invention, a spiral-wrapped foil regenerator is fabricated by etching stainless steel foil with an "original thickness", that is, thickness before being etched, ranging from about 0.025 mm to about 0.25 mm. The foil is etched from both sides to a depth of about 60% of the original thickness of the foil with a different etch pattern on the front side from the pattern on the back side using methods known to the photo-etching or chemical milling art. Where the etch patterns intersect, the foil is completely eaten away, or "through-etched", leaving a perforation. On portions of the foil that are etched from only one side, an area, described as a "depth-etched" area, is recessed from the plane of the surface of the original, unetched foil forming a channel in which a fluid can flow. Some possible etch patterns are illustrated in U.S. Pat. No. 5,429,177 and my co-pending patent application Ser. No. 09/903,302. This invention relates to a type of joint between separate sheets of foil etched with patterns suitable for use in regenerators of gas-cycle machinery. The connection comprises tabs on one sheet of foil that interlock with holes on an adjacent sheet.

Figure 6:
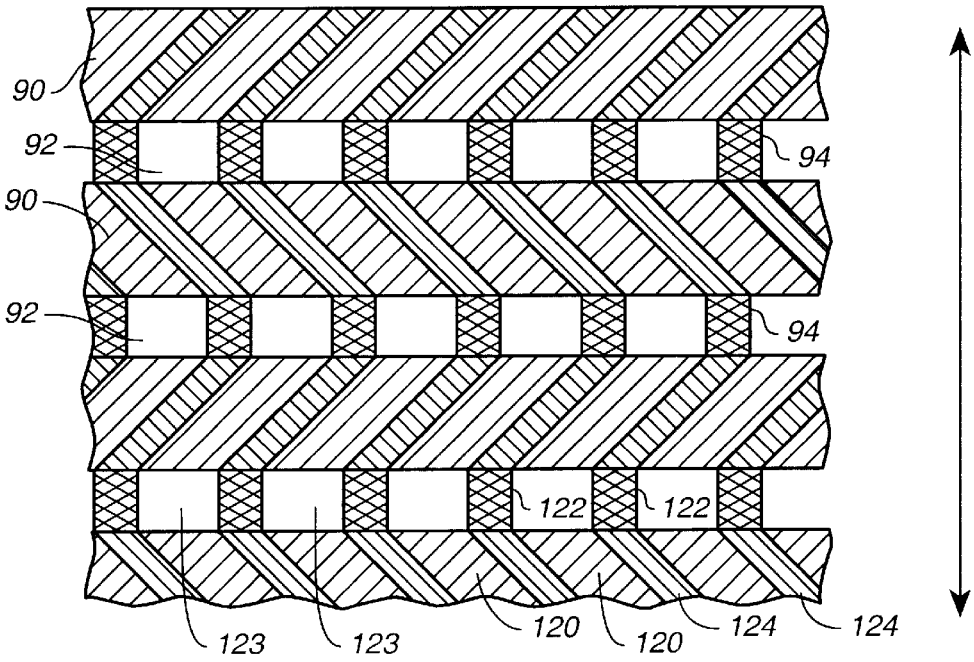
FIG. 6 PRIOR ART
FIG. 6 is a highly magnified schematic view of a portion of a piece of etched regenerator foil.

FIG. 6 is a magnified schematic representation of a portion of a piece of etched regenerator foil according to my co-pending application Ser. No. 09/903,302. Strips 90 are separated by slots 92 on the back side of the foil. Slots 92 are normal to the overall direction of flow through the regenerator, which is shown by the arrow. Strips 90 are held together with spacer straps 94 which are depth-etched on the back side. On strips 90 are portions depth etched from the front 120 to form flow channels for fluid in the regenerator. Unetched foil 124 forms the boundaries of those flow channels.

Figure 7:
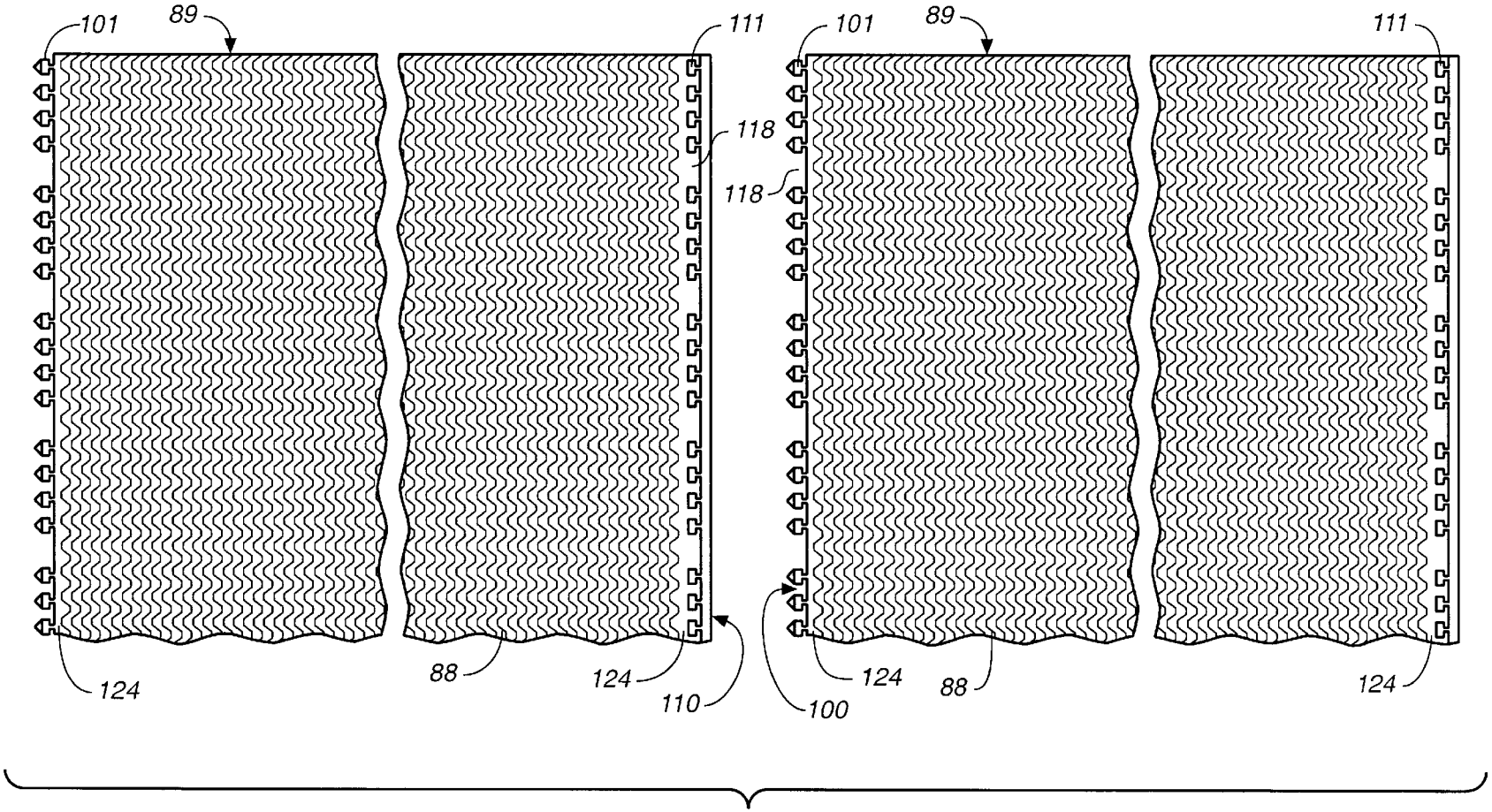
FIG. 7 is a magnified schematic view of portions of two pieces of etched regenerator foil of this invention.

FIG. 7 is a schematic view of portions of two pieces of etched regenerator foil bearing tabs 101 and holes 111 of this invention. Holes and tabs are interspersed with gaps 118. Most of the area of each piece of foil is occupied by a pattern of etched regenerator foil, such as that shown in FIG. 6. In FIG. 7, a narrow margin of unetched foil 124 lies between the portion of the foil etched with the regenerator pattern 88 and the edges bearing tabs 101 and holes 111, respectively.

Figure 8:
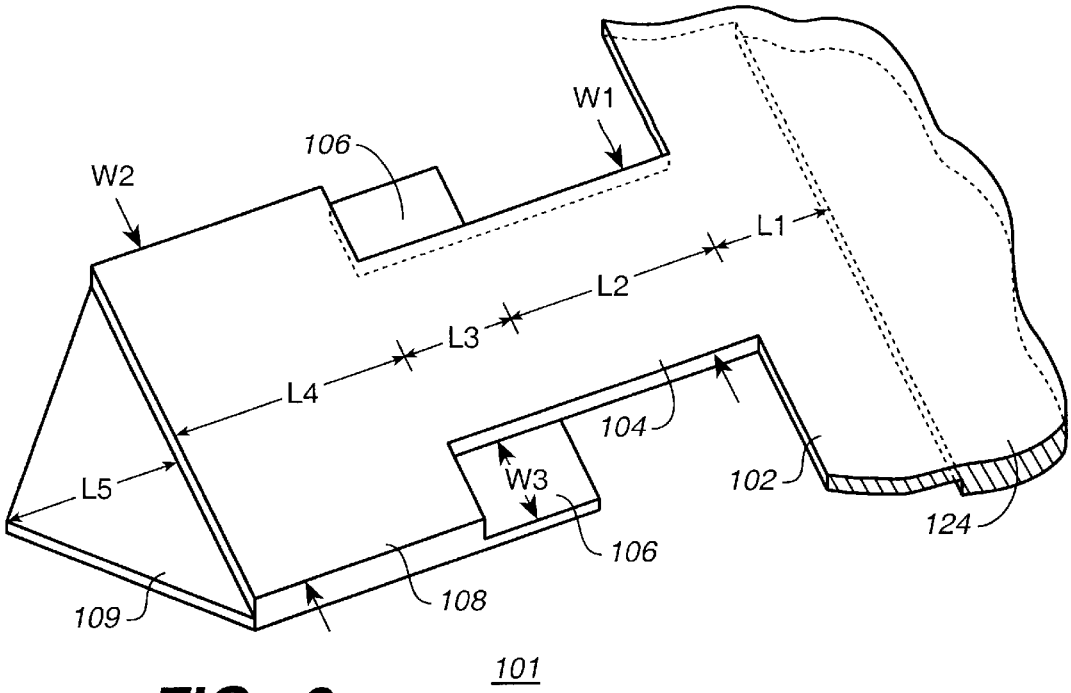
FIG. 8 is a diagramatic perspective view of a tab of this invention.

FIG. 8 is a diagramatic perspective view of a tab 101 of this invention. The unetched portion 124 is adjacent to tab end 100 of a sheet of foil as shown In FIG. 7. Tab shoulder 102, depth etched from the back side, is connected to tab neck 104, also depth etched from the back side. Two tab ears 106, each depth etched from the front side, are connected to tab head 108. Tab tongue 109, which is depth etched from the front side, is an extension of tab head 108. The tab head 108 is unetched.

Figure 9:
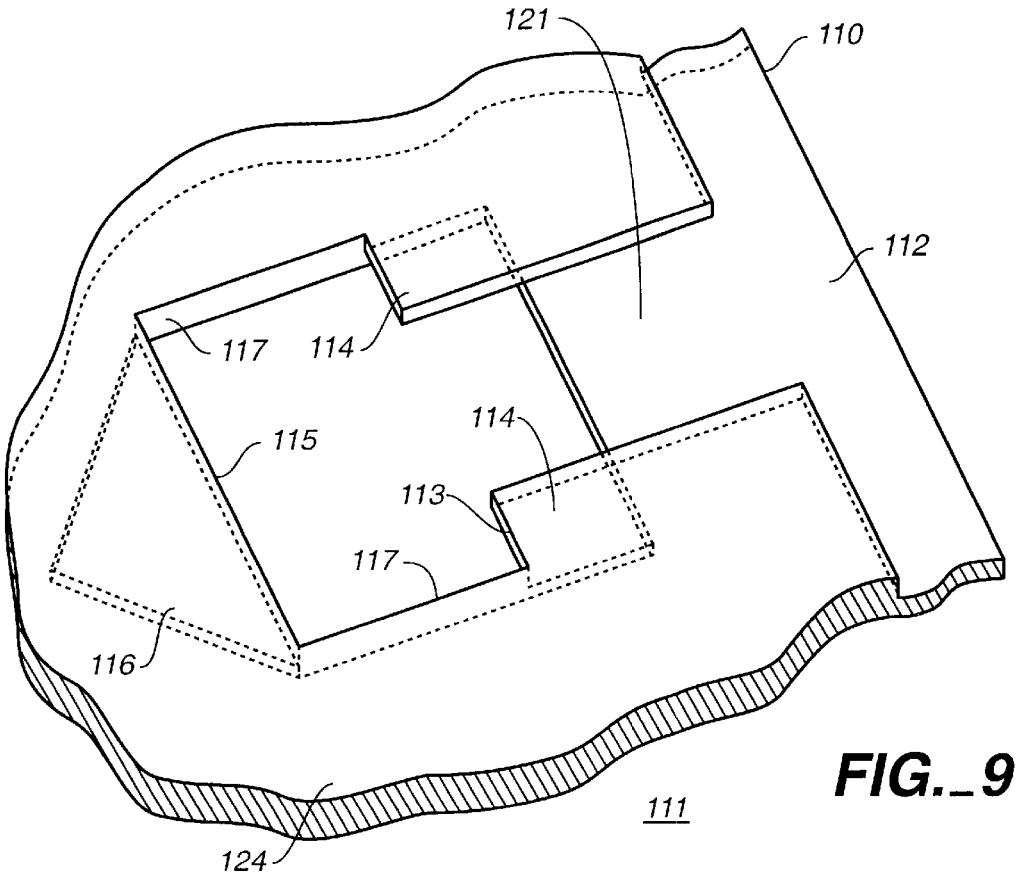
FIG. 9 is a diagramatic perspective view of a hole of this invention.

FIG. 9 is a diagramatic perspective view of a hole 111 of this invention. Hole end 110 of a sheet of foil as shown in FIG. 7 is etched with a multiplicity of holes identical to hole 111. At the extreme edge of the foil, hole end shoulder 112 is depth-etched from the front side. Neck channel 121 is also depth-etched from the front side. Hole 111 is through-etched except for hole ears 114, which are depth-etched from the back side and tongue recess 116, which is also depth-etched from the back side. Important dimensions of hole 111 are the distance from the back edge of hole ear 113 to the back edge of hole 115 and between sides of hole 117.

Figure 10:
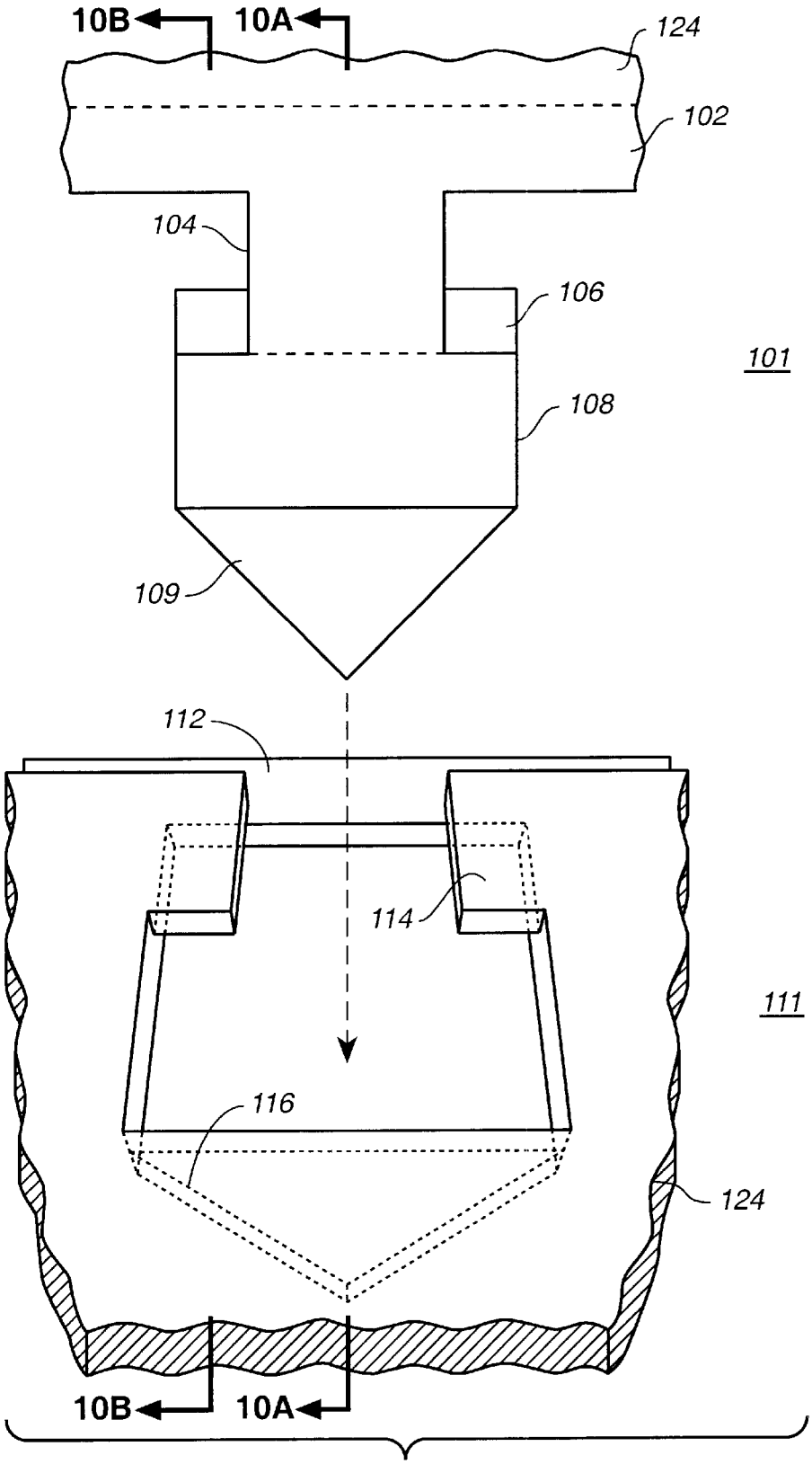
FIG. 10 is a diagramatic perspective view of a tab and hole prior to insertion of the tab into the hole.

FIG. 10 shows tab 101 in a vertical position preparatory to its insertion into hole 111, which is in a horizontal position. The elements of tab 101 and hole 111 are as in FIGS. 8 and 9, respectively.

Figure 10A:
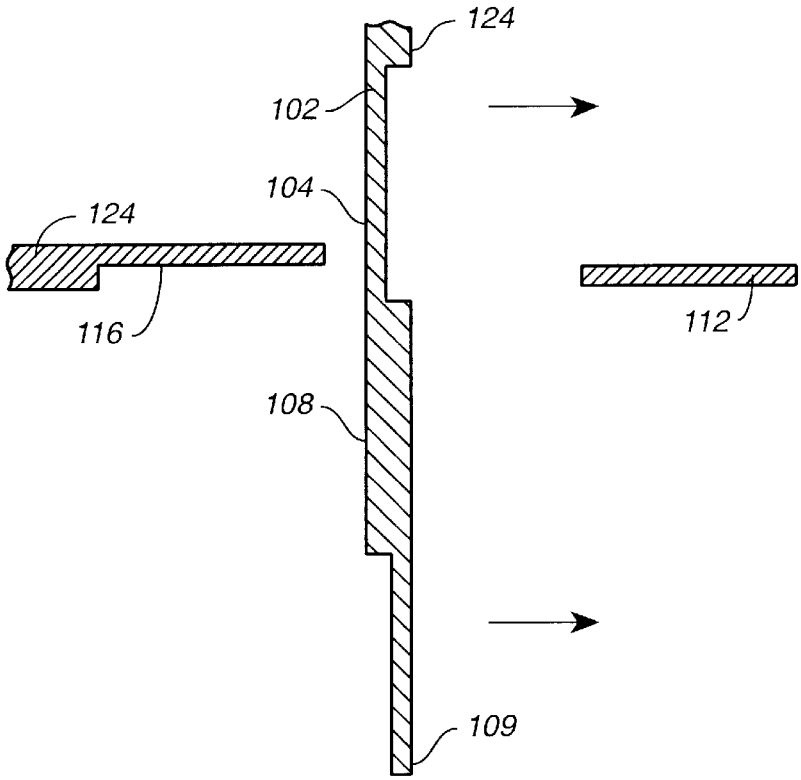
FIG. 10A is a diagramatic view of cross section A—A of the tab of FIG. 10 inserted into the hole of FIG. 10.

FIG. 10A shows a cross section A—A of the tab and hole of FIG. 10 after tab 101 has been inserted in hole 111.

Figure 10B:
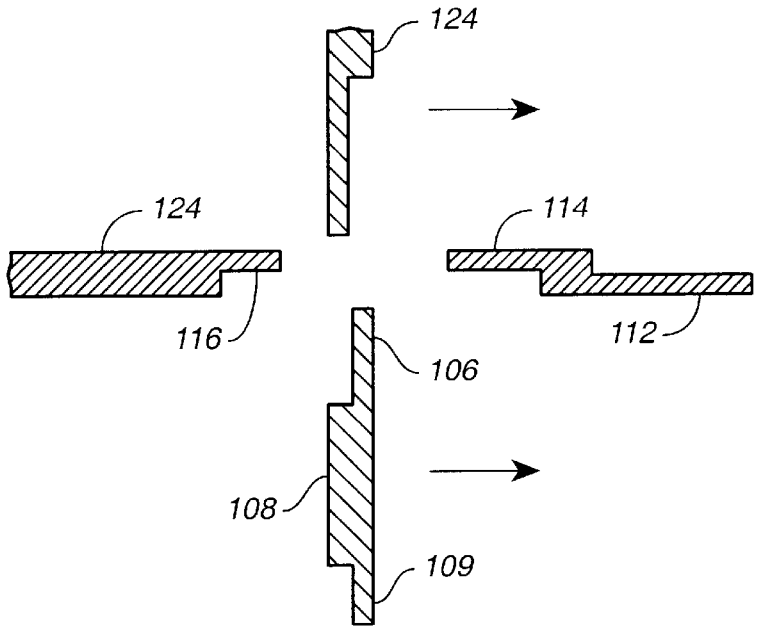
FIG. 10B is a diagramatic view of cross section B—B of the tab of FIG. 10 inserted into the hole of FIG. 10.

FIG. 10B shows a cross section B—B of the tab and hole of FIG. 10 after tab 101 has been inserted in hole 111.

Figure 10C:
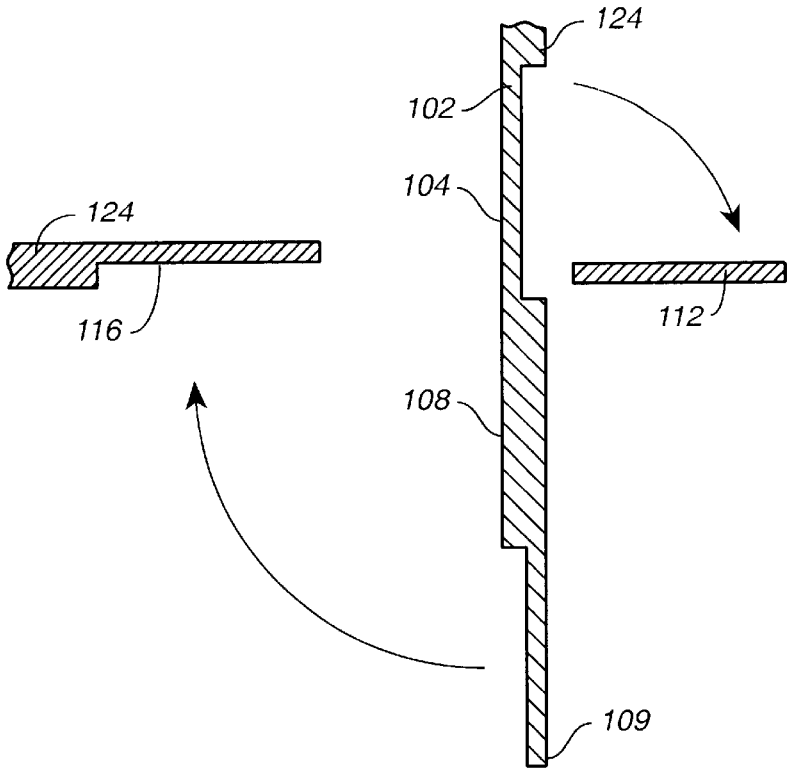
FIG. 10C is a diagramatic view of cross section A—A of the tab of FIG. 10 inserted into the hole of FIG. 10 and positioned for rotation.

FIG. 10C shows a cross section A—A of the tab and hole of FIG. 10 after tab 101 has been inserted in hole 111 and moved toward hole end shoulder 112 of the foil bearing hole 111 preparatory to being rotated into final position.

Figure 10D:
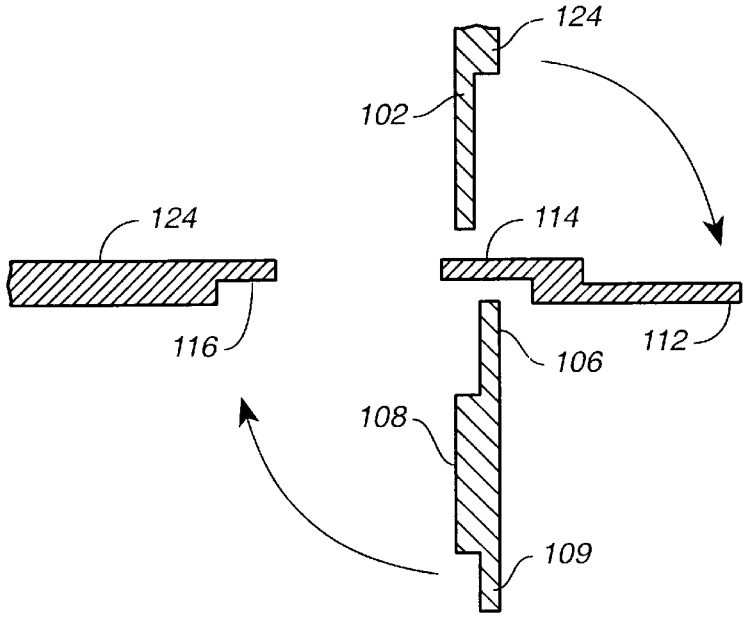
FIG. 10D is a diagramatic view of cross section B—B of the tab of FIG. 10 inserted into the hole of FIG. 10 and positioned for rotation.

FIG. 10D shows a cross section B—B of the tab and hole of FIG. 10 after tab 101 has been inserted in hole 111, and moved toward the hole end shoulder 112 of the foil bearing hole 111, preparatory to being rotated into final position. That movement brings tab ear 106 under hole ear 114.

Several dimensions of tab 101 and hole 111, shown in FIG. 8, are significant. In the assembly process, tab 101 is likely initially to miss hole 111, and will be moved in contact with unetched portions of foil before finding its way into hole 111. Tab neck 104 must be strong enough to survive the assembly process as tab 101 is being inserted into hole 111. Thus the width of tab neck W1 should be several times as great as the thickness of unetched foil 124. Tab ear 106 must be large enough to ensure that it will have substantial bearing surface on hole ear 114. Thus both length of tab ear L3 and width of tab ear W3 should be greater than the thickness of unetched foil 124. The length of tab head L4 determines the size of hole 111. Hole 111 must be large enough so that tab 101 can readily find it and drop into it during the assembly process shown in FIGS. 14A and 14B. The dimensions of the length of tab tongue L5 and the width of tab shoulder W3 are less critical, but should be sufficient to provide those surfaces with solid bearing against the corresponding surfaces adjacent to the mating hole. Dimension L5 of tab tongue 109 of FIG. 8 should be great enough to ensure that tab tongue 109 does not slip out of tongue recess 116 of FIG. 9 during assembly. Tab tongue 109 should not be longer than necessary because space occupied by tab tongue 109 of FIG. 8 takes space that could be occupied by regenerator pattern 88 as shown in FIG. 7. The dimensions of hole 111 shown in FIG. 9 should be such as to permit tab 101 of FIG. 8 to fit hole 111 of FIG. 9 with small clearance 125 to minimize short-circuit flows of fluid moving in adjacent layers of foil when the regenerator has been assembled.

Dimensions W1, W2, and W3 of FIG. 8 relate to each other in that the choice of dimensions W2 and W3 determine dimension W1. For convenience in etching and uniformity of the joint, dimension W2 may conveniently be keyed to the corresponding dimension of the regenerator pattern shown in FIGS. 13A and 13B. However, dimension W1 of FIG. 8 determines the strength of tab neck 104 of FIG. 9. Dimension W1 must remain large enough to provide strength sufficient to prevent tab neck 104 from bending during the process of connecting one piece of foil with the next piece. Moreover, dimension W3 as shown in FIG. 8 must be sufficient to ensure that tab ear 106 will engage firmly against hole ear 114 of FIG. 9 after assembly despite rounding effects of the etching process.

Preferred dimensions for a tab fabricated from unetched stainless steel foil about 0.05 mm thick are approximately as follows:

L1—0.125 mm

L2—0.125 mm

L3—0.125 mm

L4—0.225 mm

L5—0.125 mm

W1—0.2 mm

W2—0.45 mm

W3—0.125 mm

Figure 11:
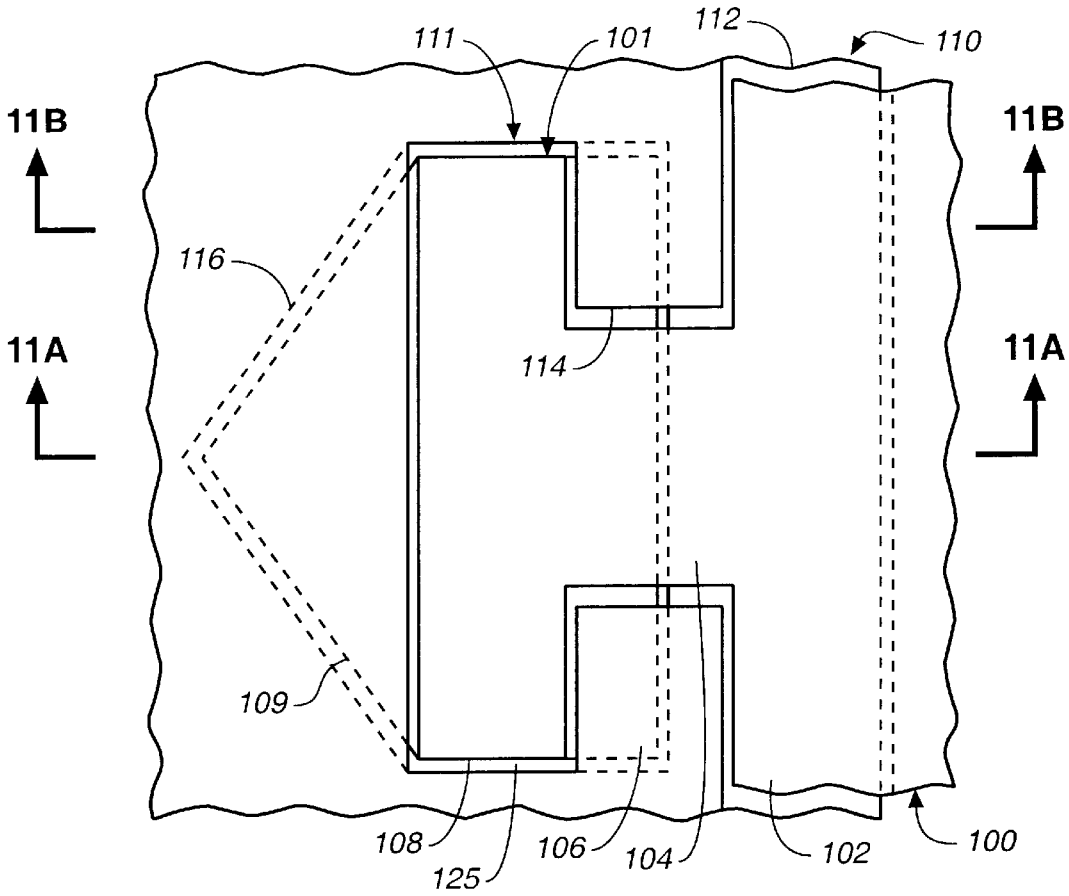
FIG. 11 shows a preferred arrangement of a tab interlocked with a hole according to this invention.
Figure 11A:
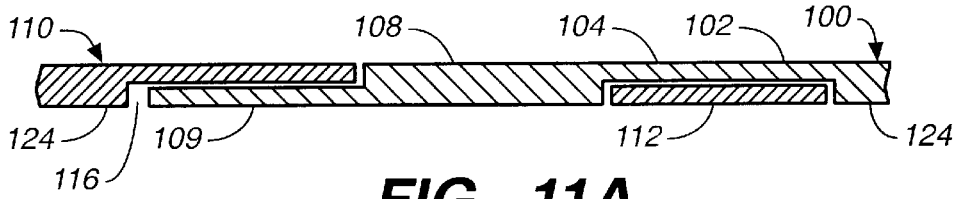
FIG. 11A is a diagramatic view of cross section A—A of the tab of FIG. 11 interlocked with the hole of FIG. 11.
Figure 11B:
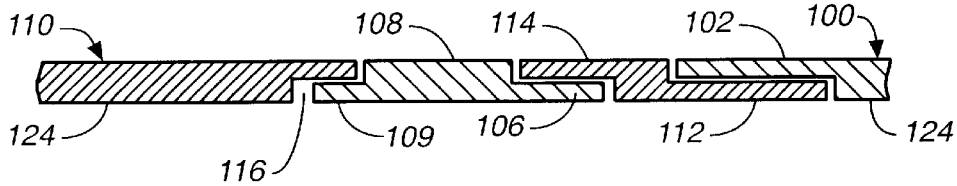
FIG. 11B is a diagramatic view of cross section B—B of the tab of FIG. 11 interlocked with the hole of FIG. 11.
Figure 12:
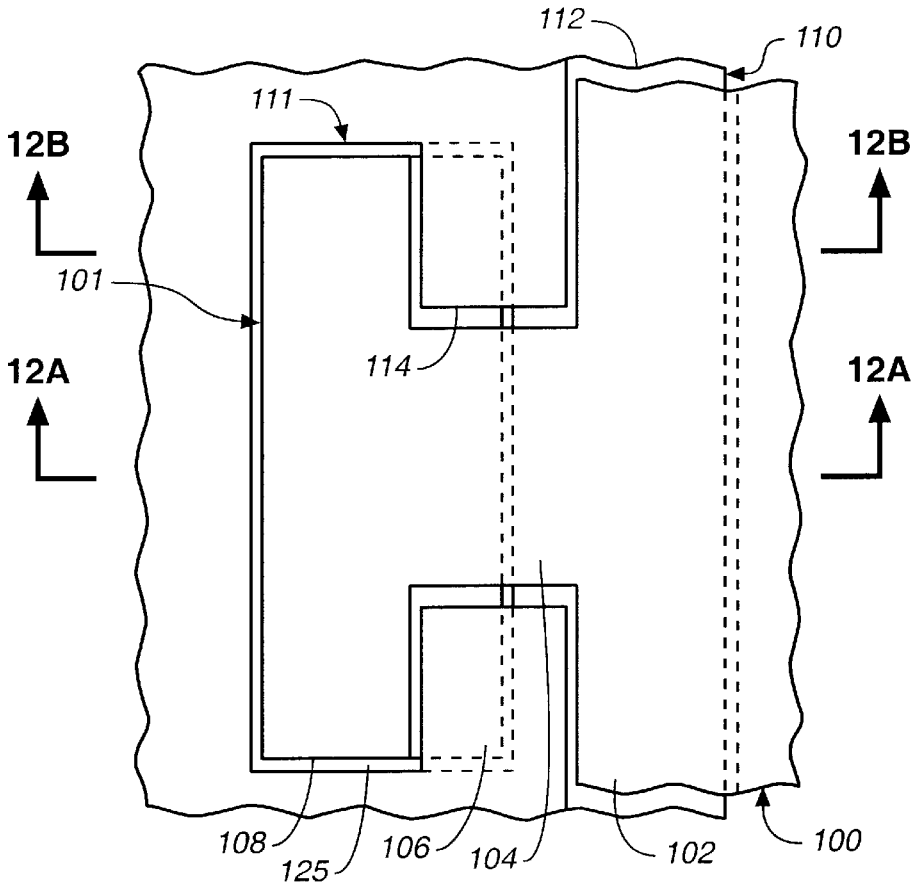
FIG. 12 is a diagramatic view of an alternate preferred arrangement of a tab interlocked with a hole according to this invention.
Figure 12A:
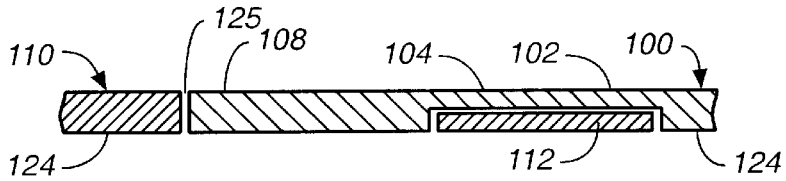
FIG. 12A is a diagramatic view of cross section A—A of the tab of FIG. 12 interlocked with the hole of FIG. 12.
Figure 12B:
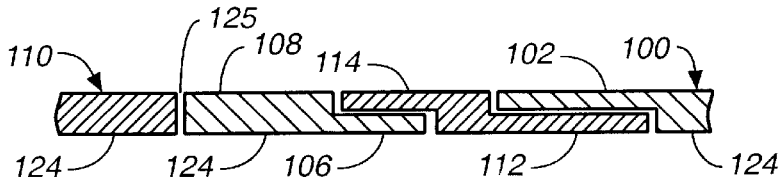
FIG. 12B is a diagramatic view of cross section B—B of the tab of FIG. 12 interlocked with the hole of FIG. 12.
Figure 13A:
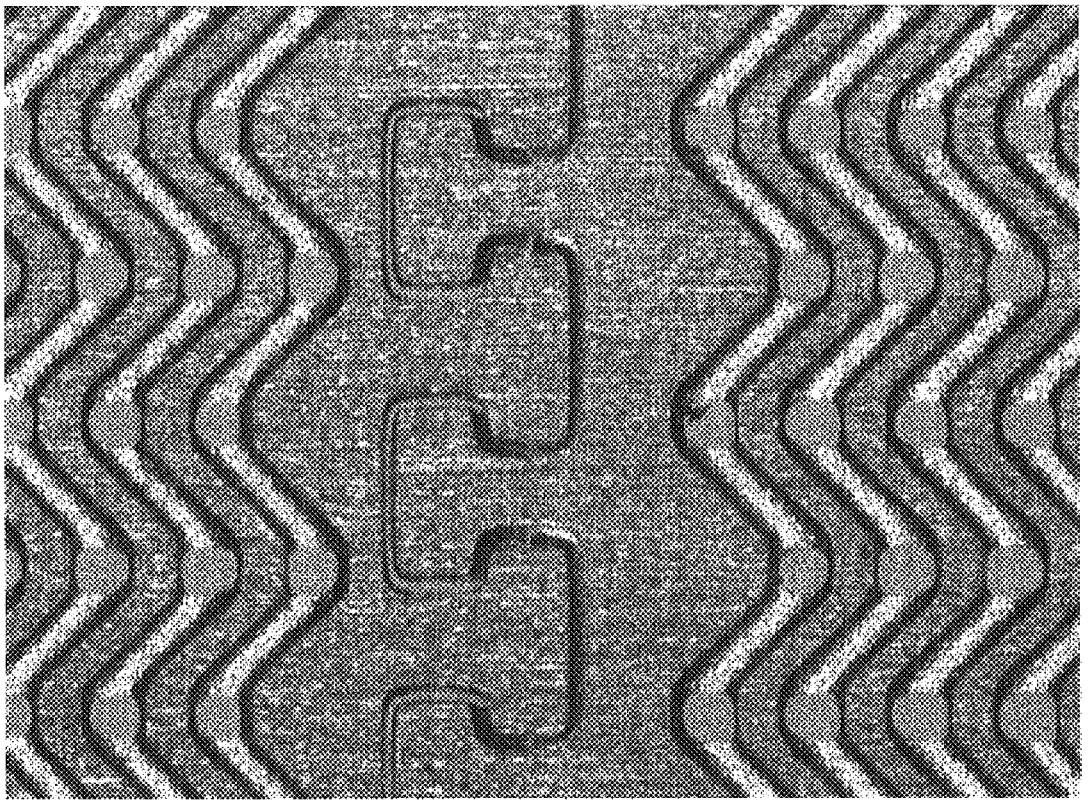
FIG. 13A is a magnified photograph of a portion of a joint between two pieces of foil with the alternate arrangement of tabs and holes shown in FIG. 12, viewed from the front side of the foil.
Figure 13B:
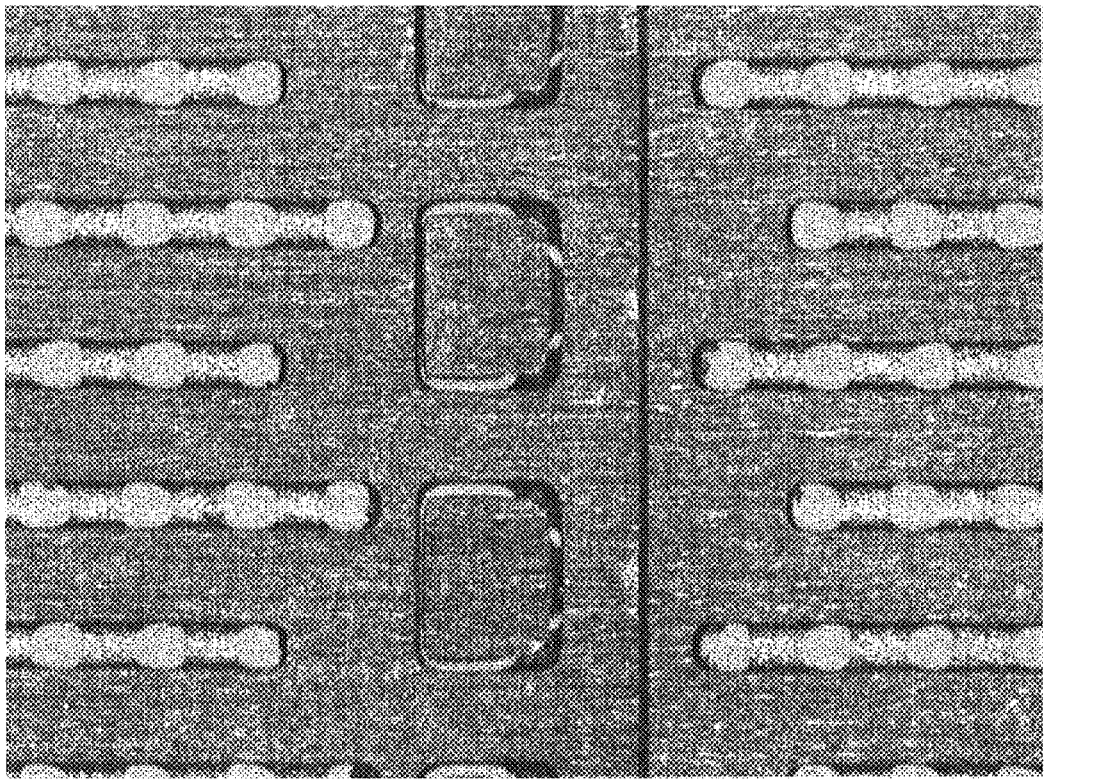
FIG. 13B is a magnified photograph of a portion of a joint between two pieces of foil with the alternate arrangement of tabs and holes shown in FIG. 12, viewed from the back side of the foil.

Those dimensions (except for the tab tongue dimension, L5) were specified for the tabs shown in FIGS. 13A and 13B. FIGS. 13A and 13B are photographs of a joint of the alternative preferred embodiment shown in FIGS. 12, 12A and 12B and illustrate a desired clearance 125 between the edges of tabs and holes. Their dimensions were dictated in part by the limitations of the photo-etching process. As shown in FIGS. 13A and 13B, etching tends to round the comers and edges of both tabs and holes, making them less sharp than as shown in FIGS. 8–12B. Tabs 101 are slightly smaller than holes 111, but clearances 125 between the edges of the tabs and the corresponding edges of the holes are of the order of magnitude of .025 mm, or about half the thickness of the foil from which they are etched.

DESCRIPTION OF THE INVENTION—FIGS. 12–14B—ALTERNATIVE PREFERRED EMBODIMENT

Figure 14A:
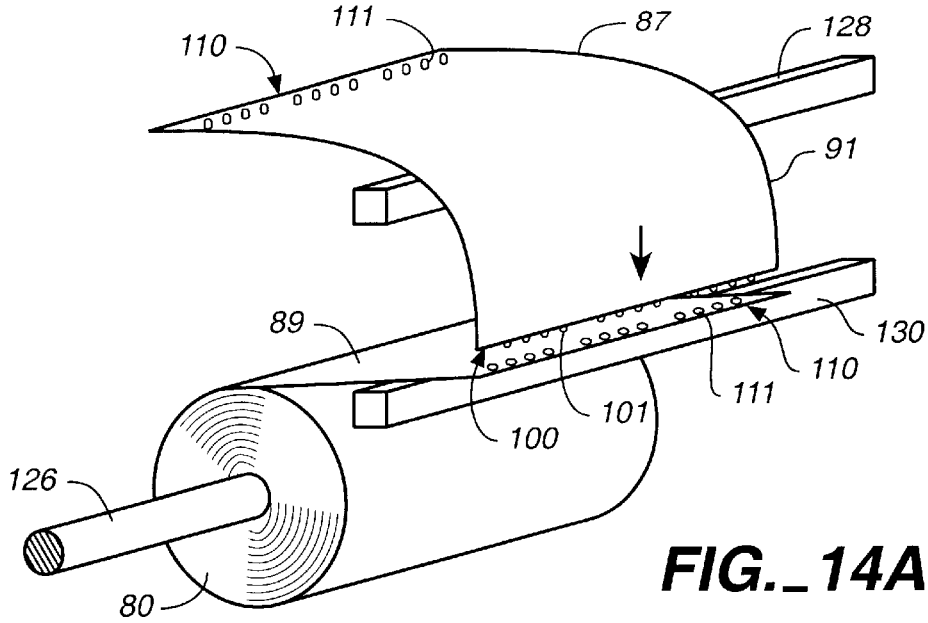
FIG. 14A shows diagramatically a preferred arrangement of separate pieces of foil prior to insertion of tabs on one piece of foil into holes on the other piece of foil.
Figure 14B:
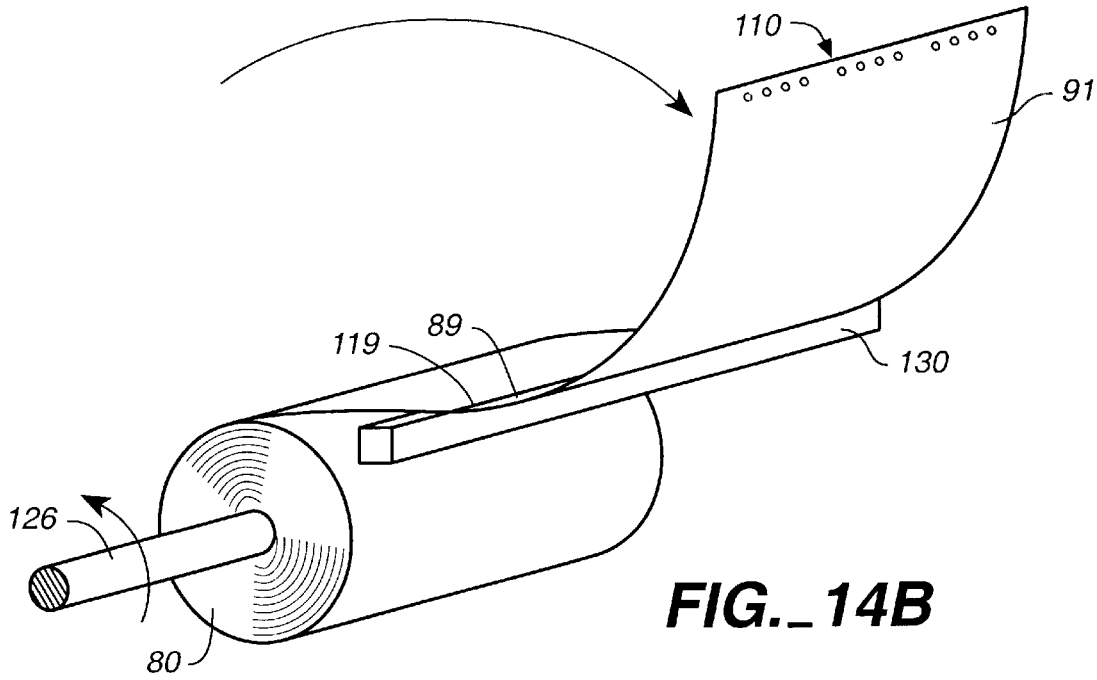
FIG. 14B shows diagramatically a piece of foil bearing tabs being interlocked with a piece of foil bearing holes.

FIGS. 12, 12A, 12B, 13A and 13B show an alternative preferred embodiment of the joint of this invention. It differs from the preferred embodiment shown in FIGS. 8–11B only in that tab tongue 109 and tongue recess 116 as shown in those figures are omitted. Assembly is as shown in FIGS. 14A and 14B, which is the same as for the preferred embodiment employing tab tongue 109 and tongue recess 116 as shown in FIGS. 8–11B. The advantage of this alternative preferred embodiment is that it saves the space otherwise occupied by a tab tongue and tongue recess. The disadvantage is that tension applied to the joint during the assembly process may cause tab 101 to tend to lift up out of hole 111; that movement is prevented by use of a tab tongue.

FIG. 12 shows tab 101 in place in hole 111 with tab ears 106 locked under hole ears 114. Tab shoulder 102 is depth-etched along tab end 100 of the piece of foil with tabs. Tab shoulder 102 lies upon hole-end shoulder 112 along hole end 110 of the piece of foil with holes. Tab head 108 substantially fills hole 111, with clearance of approximately half the thickness of the foil. This embodiment is distinguished from the embodiment shown in FIG. 11 in that tab 101 does not have tab tongue 109 as shown in FIG. 11 and hole 111 does not have tongue recess 116 as shown in FIG. 11.

FIGS. 13A and 13B are magnified photographs showing a portion of a joint between two pieces of regenerator foil using the alternative preferred embodiment shown diagramatically in FIGS. 12, 12A and 12 B. FIG. 13A shows the front sides of the two pieces of regenerator foil and FIG. 13B shows the back sides. FIGS. 13A and 13B also illustrate a preferred relationship between dimensions of holes and dimensions of the etched regenerator pattern in that both patterns repeat at the same interval in the dimension parallel to the joint.

OPERATION—FIGS. 7–14B

The purpose of the tabs 101 and holes 111 of FIG. 7 is to permit multiple separate pieces of etched regenerator foil to be assembled in a spiral wrapped foil regenerator without the need for welding or bonding. As shown in FIGS. 14A and 14B, tab end 100 of loose piece of foil 87 may be attached to hole end 110 of a piece of foil that is part of multiple layers of foil 80 wrapped around rotatable shaft 126.

The process of attachment requires that each tab 101 of loose piece of foil 87 be inserted into a corresponding hole 111 of the piece of foil that is already partially wrapped on rotatable shaft 126 as shown in FIGS. 14A and 14B. Particularly in cryocooler regenerators in which the optimum thickness of regenerator foil is around 0.05 mm before it is etched, tabs 101 and holes 111 can be so small as to be barely visible with normal, unaided vision. Moreover, foil of that thickness is flexible. Tab neck 104 of each tab, as shown in FIG. 8, is depth-etched from the back side, and its thickness and strength reduced as a result. Assembly of a regenerator from multiple pieces of foil can thus be a delicate process.

In order to get all of the tabs 101 on one piece of foil into the corresponding holes 111 on the mating piece as shown in FIGS. 14A and 14B, lower foil support 130 may be placed so as to hold the piece of foil bearing holes in a substantially horizontal position with front side 89 of the foil bearing holes 111 facing upward. (That is the opposite orientation from that shown in FIG. 6. Loose piece of foil 87 bearing tabs may then be draped over upper foil support 128 as shown in FIG. 14A, and gently lowered, with tab end 100 down. Loose piece of foil 87 will tend to bend as shown in FIGS. 14A and 14B due to stress relief during the etching process. No attempt should be made to flatten loose piece of foil 87. Rather, it may be guided so that tab end 100 is substantially vertical and hole end 110 is substantially horizontal.

Loose piece of foil 87 is draped over upper support 128 to take almost all of the weight of the foil off of tabs 101, permitting assembly using nothing more than gentle pressure to align the tabs with holes 111. The weight put on tabs 101 should be insufficient to collapse them if they are rested on surfaces adjacent to holes 111 on hole end 110 of the piece of foil to which loose piece of foil 87 is to be joined. Tab end 100 of loose piece of foil 87 can then be wiggled slightly until tabs 101 find their corresponding holes 111 and drop through. Once the tabs drop into the holes, loose piece of foil 87 can be locked to the preceding piece of foil by simultaneously pressing and tipping it forward as shown in FIG. 144B. Tabs 101 will then lock in holes 11 as shown in FIGS. 10–13B. The gaps 118 between groups of tabs and groups of holes, as shown in FIG. 7, assist in alignment of the joint by preventing misaligned tabs from penetrating at gaps in the holes.

A key feature of the structure is the relatively large tab heads. The large, full-thickness portion of each tab almost completely fills the relatively large hole through which the tab is inserted. The large tab heads plug the holes, allowing the holes to be relatively large without creating any substantial opportunity for short-circuit flows. The generous dimensions of the holes, in turn, make it possible to get a substantial number of tabs into their holes with relative ease and without the need for high-precision fixtures or robotic assembly.

When tabs and holes are fully engaged, rotatable shaft 126 may be rotated as shown in FIG. 14B while the piece of foil that has just been connected to the preceding piece is partially rolled into the roll of layers of foil 80, leaving its hole end 110 free so that the next piece of foil may be added. Successive pieces of foil can thus be connected to each other to create as many layers of foil 80 as desired. To produce a tightly-wrapped regenerator, some tension should be applied to the free end of the piece of foil last added as it is being rolled up.

Rotation of rotatable shaft 126 of FIGS. 14A and 14B can be accomplished with a stepper motor, servomotor or DC gear motor controlled by a foot switch in a manner known to the electric motor art. A removable mandrel can be attached to the rotatable shaft to permit its removal after the regenerator has been wound.

In a preferred assembly procedure for a regenerator of this invention, a first piece of foil is rolled on a mandrel and glued to itself leaving an edge equipped with holes of this invention free. The first piece of foil may be a solid piece that thus forms a solid steel jacket on the inside of the regenerator. The glue may be allowed to set before the next piece is attached, to avoid fouling the flow passages in the pattern with glue. A two-part non-stick mandrel of PTFE plastic may be used if it is to be removed after the assembly process is complete. When cooled, the mandrel will shrink more than does the regenerator, facilitating removal of the mandrel. Alternatively, any suitable material such as G-10 glass-filled epoxy (for cryocoolers) or stainless steel (for engines) may be used as a mandrel and left in place after the regenerator has been assembled.

To complete the regenerator, the last piece of loose foil 87 attached to the preceding piece of foil may be a piece of foil that is unetched except for tabs at its end. The length of that piece of foil should be at least as great as the circumference of the finished regenerator. The free end of that piece of foil may then be welded or bonded to itself to form a gas-tight jacket surrounding the finished regenerator.

The assembly process described above can be accomplished by hand with minimal tooling if care has been taken to ensure that each piece of foil to be installed in the regenerator is unwrinkled and that all tabs are straight and undamaged. Other methods known to the automation art could make possible an automated assembly process if the quantity of regenerators to be produced warranted the expense of the necessary equipment.

ADVANTAGES

Etched foil is an especially useful regenerator material for annular regenerators such as are shown in FIGS. 2 and 3 (prior art). The foil can be wrapped on a cylinder that serves as a pulse tube or as the displacer cylinder of a Stirling cycle machine to build up multiple layers of foil. Patterns in my co-pending application Ser. No. 09/903,302 distribute flow in an annular regenerator more evenly in a circumferential direction than does any other known material.

Despite their advantages, a fundamental problem with spiral-wrapped etched foil regenerators is that it is difficult to etch large pieces of regenerator foil and impractical to etch single pieces large enough to form a regenerator of any significant size. Thus, some method of joining several pieces of foil together must be employed to create a single piece that can be wrapped to form the regenerator. Gluing, welding and other approaches have been tried, but all have their limitations and difficulties. Glue tends to get loose and block flow passages in the foil in unpredictable ways. Welding is difficult and expensive.

The welding process has the further disadvantage that it requires the entire strip of foil to be welded together before the rolling process begins. That means that the completed strip must be handled with great care, because damage to any portion of the strip compromises the entire regenerator. A complete regenerator contains a sufficient mass of material so that the weight of the strip, if not carefully handled, is sufficient to cause irreparable damage to its constituent foil.

This invention permits the use of small, easily fabricated pieces of regenerator foil that can be linked together to produce a regenerator of any desired size. Thus the same etch pattern can be used to make foil for a family of regenerators of varying size. If a piece of foil is damaged during assembly, it can be removed and replaced easily, without discarding the entire regenerator. If the foil varies somewhat from specified thickness (and variations in thickness of a piece nominally 0.050 mm thick are hard to detect) the number of pieces of foil in a regenerator can be adjusted to bring it to the right final dimensions. The joints themselves are smooth, flat, and virtually immune to short-circuit flows because the gaps in the joints are smaller than the etched flow passages and are not continuous from one end of the-regenerator to the other.

CONCLUSIONS, RAMIFICATIONS AND SCOPE

This invention improves upon prior art spiral-wrapped etched foil regenerators by improving their uniformity and reducing their cost. It solves a problem that has bedeviled attempts to assemble tight, uniform rolls of etched foil to create regenerators. It permits quick, easy assembly of multiple pieces of foil, integrated with the regenerator-rolling process. It eliminates an expensive and troublesome step in which strips of foil are welded or glued end-to-end. It reduces the risk of damage to the foil by keeping the foil in small pieces that can be handled easily and that do not self-destruct by sagging and deforming under their own weight.

Although the description above contains many specifics, these should not be construed as limiting the scope of the invention but merely as providing illustrations of some of the presently preferred embodiments of this invention Thus, the scope of the invention should be determined by the appended claims and their legal equivalents, rather than by the examples given.

I claim:

1. A joint connecting a second piece of etched regenerator foil to a first piece of etched regenerator foil of substantially the same original thickness as the original thickness of said second piece of etched regenerator foil wherein a multiplicity of tabs on said second piece of regenerator foil interlock with a multiplicity of holes in said first piece of etched regenerator foil, and wherein said tabs substantially fill said holes.

2. The joint of claim 1 wherein said joint is not substantially thicker than the original thickness of said second piece of etched regenerator foil.

3. The joint of claim 2 wherein clearances between edges of said tabs and edges of said holes are no greater than the original thickness of said second piece of etched regenerator foil.

4. The joint of claim 2 wherein an edge of said second piece of etched regenerator foil has a shoulder etched to a depth equal to or greater than half the original thickness of said second piece of etched regenerator foil, and wherein an edge of said first piece of etched regenerator foil has a shoulder etched to a depth equal to or greater than half the original thickness of said first piece of etched regenerator foil.

5. The joint of claim 2 wherein said tabs have depth-etched tab ears, and wherein said first piece of regenerator foil has depth-etched hole ears.

6. The joint of claim 2 wherein said tabs have depth-etched tab tongues, and wherein said first piece of regenerator foil has depth-etched tongue recesses.

7. The joint of claim 2 wherein said tabs have tab heads which are substantially the same thickness as the original thickness of said second piece of etched regenerator foil.

8. The joint of claim 2 wherein an edge of said second piece of etched regenerator foil has a shoulder etched to a depth equal to or greater than half the original thickness of said second piece of etched regenerator foil, and wherein an edge of said first piece of etched regenerator foil has a shoulder etched to a depth equal to or greater than half the original thickness of said first piece of etched regenerator foil, and wherein said tabs have depth-etched tab ears, and wherein said first piece of regenerator foil has depth-etched hole ears, and wherein said tabs have tab heads which are substantially the same thickness as the original thickness of said second piece of etched regenerator foil.

9. The joint of claim 8 wherein said tabs have depth-etched tab tongues, and wherein said first piece of regenerator foil has depth-etched tongue recesses.

10. In a spiral-wrapped foil regenerator assembled from a multiplicity of separate pieces of regenerator foil of substantially the same original thickness, an improvement comprising:

a multiplicity of tabs on a second piece of said regenerator foil interlocked with a multiplicity of holes on a first piece of said regenerator foil wherein said tabs substantially fill said holes.

11. The spiral-wrapped foil regenerator of claim 10 wherein clearances between edges of said tabs and edges of said holes are no greater than the original thickness of said second piece of regenerator foil.

12. The spiral-wrapped foil regenerator of claim 10 wherein an edge of said second piece of regenerator foil has a depth-etched shoulder of a thickness equal to or less than half the original thickness of said second piece of etched regenerator foil, and wherein an edge of said first piece of etched regenerator foil has a depth-etched shoulder etched to a depth equal to or greater than half the original thickness of said first piece of etched regenerator foil.

13. The spiral-wrapped foil regenerator of claim 10 wherein said tabs have depth-etched tab ears, and wherein said first piece of regenerator foil has depth-etched hole ears.

14. The spiral-wrapped foil regenerator of claim 10 wherein said tabs have depth-etched tab tongues, and wherein said first piece of regenerator foil has depth-etched tongue recesses.

15. The spiral-wrapped foil regenerator of claim 10 wherein said tabs have tab heads which are substantially the same thickness as the original thickness of said second piece of etched regenerator foil.

16. The spiral-wrapped foil regenerator of claim 10 wherein an edge of said second piece of etched regenerator foil has a depth-etched shoulder of a thickness equal to or less than half the original thickness of said second piece of etched spiral-wrapped foil regenerator foil, and wherein an edge of said first piece of etched regenerator foil has a depth-etched shoulder etched to a depth equal to or greater than half the original thickness of said first piece of etched regenerator foil, and wherein said tabs have depth-etched tab ears, and wherein said first piece of regenerator foil has depth-etched hole ears, and wherein said tabs have tab heads which are substantially the same thickness as the original thickness of said second piece of etched regenerator foil.

17. The spiral-wrapped foil regenerator of claim 16 wherein said tab heads have depth-etched tab tongues, and wherein said first piece of regenerator foil has depth-etched tongue recesses.

* * * * *

UNITED STATES PATENT AND TRADEMARK OFFICE

CERTIFICATE OF CORRECTION

PATENT NO. : 6,732,785 B2
DATED : May 11, 2004
INVENTOR(S) : Matthew P. Mitchell It is certified that error appears in the above-identified patent and that said Letters Patent is hereby corrected as shown below:

Title page,
Item [57], ABSTRACT,
Line 6, "tabs" is corrected to read -- holes --

Column 4,
Line 27, "82 central opening" is deleted

Column 5,
Line 26, "surround" is corrected to read -- surrounds --

Column 8,
Line 59, "FIG.6." is corrected to read -- FIG. 6). --

Column 9,
Line 13, "FIG.144B. Tabs 101 will then lock in holes 11 as shown in" is corrected to read -- Fig. 14B. Tabs 101 will then lock in holes 111 as shown in --

Signed and Sealed this

Fourteenth Day of September, 2004

JON W. DUDAS
*Director of the United States Patent and Trademark Office*